US010781583B2

(12) United States Patent
Silva

(10) Patent No.: US 10,781,583 B2
(45) Date of Patent: Sep. 22, 2020

(54) FITTING PROFILE FOR PREFABRICATION CONSTRUCTIVE SYSTEM AND ASSEMBLY METHOD OF A FITTING PROFILE SYSTEM

(71) Applicant: Concexec—Arquitectura, LDA., Oliveria de Azemeis (PT)

(72) Inventor: Jaime Alberto Fernandes Silva, Oliveira de Azemeis (PT)

(73) Assignee: Concexec—Arquitectura, LDA, Oliveira de Azemeis (PT)

( * ) Notice: Subject to any disclaimer, the term of this patent is extended or adjusted under 35 U.S.C. 154(b) by 0 days.

(21) Appl. No.: 15/766,909

(22) PCT Filed: Oct. 6, 2016

(86) PCT No.: PCT/PT2016/050021

§ 371 (c)(1),
(2) Date: Apr. 9, 2018

(87) PCT Pub. No.: WO2017/061886

PCT Pub. Date: Apr. 13, 2017

(65) Prior Publication Data

US 2018/0298612 A1 Oct. 18, 2018

(30) Foreign Application Priority Data

Oct. 9, 2015 (PT) ..... 108880

(51) Int. Cl.
*E04B 1/24* (2006.01)
*E04B 1/58* (2006.01)

(52) U.S. Cl.
CPC ..... *E04B 1/2403* (2013.01); *E04B 1/5831* (2013.01)

(58) Field of Classification Search
CPC ..... E04B 1/5831; E04B 2/762; E04B 2/7818; E04C 2003/0413; E04C 3/04; E04H 17/20
See application file for complete search history.

(56) References Cited

U.S. PATENT DOCUMENTS 3,332,197 A * 7/1967 Hinkle ..... E04C 3/06 52/844
3,349,538 A * 10/1967 Virginia ..... E04B 1/5831 256/59
4,987,717 A 1/1991 Dameron, Jr.
(Continued)

FOREIGN PATENT DOCUMENTS

| | | |
|---|---|---|
| EP | 1624127 B1 | 2/2007 |
| FR | 2821101 B1 | 8/2002 |
| WO | 2010013233 A2 | 2/2010 |

*Primary Examiner* — Andrew J Triggs
(74) *Attorney, Agent, or Firm* — The Watson IP Group, PLC; Jovan N. Jovanovic

(57) ABSTRACT

The present invention is directed to a fitting profile (1), a fitting profile system, and an assembly method of the fitting profile system. Said profile (1) comprises two tabs (2, 3) perpendicularly connected to each other at a joint (9). At its inner (20) surface, tab (2) comprises a shoulder (10) with a fitting member (6) of the male type disposed thereon. At its end, tab (3) comprises a fitting member (7) of the female type. The shape of each of said fitting members (6, 7) is complementary to each other so as to allow a fitting attachment into another identically shaped profile. Profile (1) is particularly intended to be built-in in panels in order to facilitate and simplify their coupling.

18 Claims, 20 Drawing Sheets

(56) References Cited

U.S. PATENT DOCUMENTS

| | | | | |
|---|---|---|---|---|
| 5,095,678 | A * | 3/1992 | Murphy | E04C 3/07 52/844 |
| 7,155,874 | B2 * | 1/2007 | Lee | E04B 1/24 52/843 |
| 2006/0186390 | A1 * | 8/2006 | Richards | E04H 17/1413 256/22 |

* cited by examiner

FITTING PROFILE FOR PREFABRICATION CONSTRUCTIVE SYSTEM AND ASSEMBLY METHOD OF A FITTING PROFILE SYSTEM

FIELD OF THE INVENTION

The present invention is directed to a fitting profile for a prefabrication constructive system, and an assembly method of a fitting profile system. The present invention is applicable to the building industry, and is applicable more particularly to panels to be used in modular constructions of all kinds of structures.

BACKGROUND OF THE INVENTION

At a time when sustainability is a top priority, in the field of architecture there is a commitment to use available resources to create living spaces, responding to increased demand for modular constructions within and across borders.

It is well known to use profiles to connect modules or parts intended for modular construction of structures in order to allow the coupling of said modules or parts to form the desired structure or construction.

Typically, the coupling of said profiles to each other is made by using fastening means such as screws, rivets, welding, etc. This profile fastening method is not very versatile in that it needs skilled labour, and its application is time consuming. Moreover, difficulties or even impossibility to carry out the removal of such fastening means are a source of problems regarding the disassembly of said profiles considering its reutilization.

More recently, profile connection systems by means of fitting have been used, which partially do not require using said fastening means, but which have proved insufficient to remedy the problem of a secure attachment, which was previously achieved by using the aforementioned conventional fastening means.

As an example of such structures one may refer the Portuguese utility model No. 10618 which discloses a metal structure for modular construction constituted by a profile with a "C" shaped section connected to two tops with a "L" shaped section at each of its ends, by welding, to form a profile with a "H" shaped section. The profile with a "H" shaped section is then connected to another profile with the same type of section by means of a tube. Said structure using different combinations allows building structures with various configurations or designs.

In accordance with the foregoing, a need exists for a profile that may be built-in in modules or parts, whose attachment of said profiles to each other is performed by fittings which allow to attach and support modular constructions, are more cost saving with controlled cost, and whose assembly is faster and easy to achieve without using conventional fastening means.

Such assemblies should still be able to be easily removed, allowing the structure to be reconfigured, thereby ensuring their rehabilitation.

SUMMARY OF THE INVENTION

The present invention is directed to a fitting profile (1) for a constructive system comprising two tabs (2, 3) connected perpendicularly to each other at a joint (9), each tab having respectively an inner surface (20, 30), an outer surface (21, 31) and an end (4, 5) opposite to said joint (9), the profile (1) being characterized in that:

tab (2) comprises on its inner surface (20) a shoulder (10) having a thickness (h'), in which shoulder (10) a fitting member (6) of the male type is disposed, at end (5) of tab (3) a fitting member (7) of the female type provided with an opening (11) having a thickness (h") is disposed, and the shape of each of said fitting members (6, 7) is complementary relative to each other so as to allow a fitting attachment into another identically shaped profile.

In one aspect, said thickness (h') of shoulder (10) is identical to a thickness (h) of profile (1).

In another aspect, said thickness (h') of shoulder (10) is equal to or less than said thickness (h") of opening (11) of fitting member (7) of the female type.

In one embodiment of the present invention, said shoulder (10) is disposed over the entire inner surface (20) parallel to end (4).

In a further aspect, said thickness (h") of opening (11) of fitting member (7) of the female type is the same as the thickness (h) of profile (1).

In another embodiment of the present invention, said fitting member (7) of the female type is disposed along the entire end (5).

Preferably, said fitting member (7) of the female type has a U shape.

In another embodiment, shoulder (10) and fitting member (6) of the male type are arranged integrally on inner surface (20).

In a further embodiment, fitting member (7) of the female type is arranged integrally on end (5).

The present invention also relates to a fitting profile system (12) characterized in that it comprises two profiles (1, 1') as claimed in any one of preceding claims, and a locking member (8).

In one embodiment the locking member (8) is a plate (81). In another embodiment said locking member (8) is a profile (82). In a further optional embodiment said locking member (8) is a rod or bar (83).

The invention further relates to an assembly method of fitting profile system (12) previously defined, the method being characterized in that it comprises the steps of:

a) attaching two profiles (1, 1') of system (12) by fitting the fitting members (6, 7) of profile (1) into fitting members (7', 6') respectively of profile (1'), and b) blocking the attachment performed in the preceding step by placing a locking member (8) between shoulders (10, 10') of respective profiles (1, 1').

Preferably, in step b) referred to above, the locking member (8) is placed between shoulders (10, 10') of respective profiles (1, 1') by a sliding movement of the drawer type.

BRIEF DESCRIPTION OF DRAWINGS

The following is a description of the invention with reference to the accompanying drawings, wherein.

DETAILED DESCRIPTION OF THE INVENTION

Figure 1:
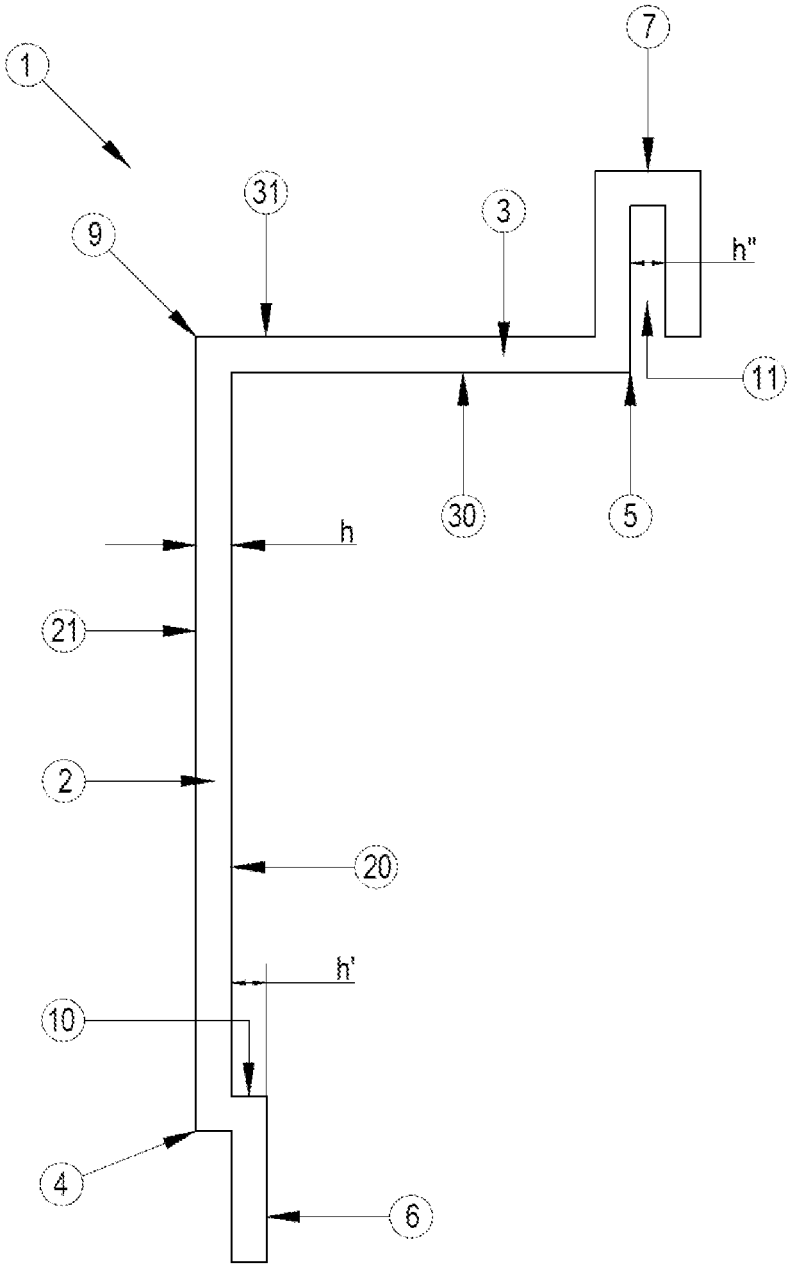
FIG. 1 shows a cross section of a preferred embodiment of the fitting profile of the present invention.

Referring to the accompanying figures, a solution that allows the combination of parts or modules provided with the fitting profiles (1) of the present invention, that by means of a fitting system (12) and of a locking member guarantee their coupling, is herein presented. The assembly of the profiles of the present invention is achieved by a male-female type fitting system allowing its conjugation in order to enable the concept of modular construction based on principles of industrialized construction.

The articulated joint between modules enhances the formation of different typologies, and the expansion or reduction of rooms in the same building through the increase or decrease of standard panels is possible, for example. These constructions can be modified according to use requirements, and can even be dismantled and moved to another geographic area.

The present invention is directed to a fitting profile (1) for a prefabrication constructive system, and to an assembly method of a fitting profile system (12). Said profile (1) is particularly intended to be built-in in panels in order to facilitate and simplify their coupling.

This invention provides coupling in an easy and safe manner by means of a fitting connection of a profile (1) of the present invention into another identical profile (1'), such coupling being then blocked by means of a locking member (8), eliminating the use of conventional fastening means referred to above to maintain said profiles (1, 1') in a coupled state.

The design of the profile (1) of the present invention enables an easy assembly and disassembly of building modules without the need for expensive attachment processes, which makes this a very versatile solution.

Since the assembly of profile systems of the invention relies on a coupling by means of a male-female type fitting, it is essential to ensure that such fitting is not inadvertently undone, but it is also essential that the required blocking of said fitting could be easily and quickly reversed so as to provide the invention with the benefits mentioned above.

To block the system (12) of profiles (1, 1') a locking member (8), which arrangement in system (12) will be achieved by means of a fitting method with a movement of the drawer type, is used. The profile system (12), after being assembled, is shown in FIGS. 7 to 10 and 17 to 20.

In the context of the present invention, the term "tab" refers to the essential structural members forming the profile, which are depicted exemplarily in the figures with reference to numerals (2) and (3).

The expression "male-female type fitting" refers to a fitting between two profiles of the present invention, in which a fitting member of the male type of a first profile can be inserted into a fitting member of the female type of a second profile identical to the first profile in order to establish an attachment between the two profiles. The shapes of the members to be fitted are naturally complementary to allow a proper fitting. FIGS. 7 to 10 illustrate fittings of male-female type.

The expression "fitting member of the male type" refers generally to a projection, for example a pin or rod, disposed in one of the tabs belonging to a profile of the invention, whose projection is prepared to cooperate with a fitting member of the female type disposed in another identical profile in order to establish an attachment.

The expression "fitting member of the female type" refers generally to a recess or opening arranged in the other tab of the same profile, wherein said recess or opening is prepared to cooperate with a fitting member of the male type of another identical profile in order to establish an attachment.

In the context of the present description, the term "comprising" should be interpreted as "including, among others". As such, said term should not be interpreted as "consisting only of".

With reference to FIG. 1, the present invention relates to a fitting profile (1) proper to be used in a constructive system in the building industry, the profile (1) comprising two tabs (2, 3) connected perpendicularly to each other in a joint (9). Each tab (2, 3) have respectively an inner surface (20, 30), an outer surface (21, 31) and an end (4, 5) opposite to said joint (9).

The tab (2) of the profile (1) comprises on its inner surface (20) a shoulder (10) having a thickness (h'), in which shoulder (10) a fitting member (6) of the male type is disposed, such as exemplified in FIG. 1.

Figure 11:
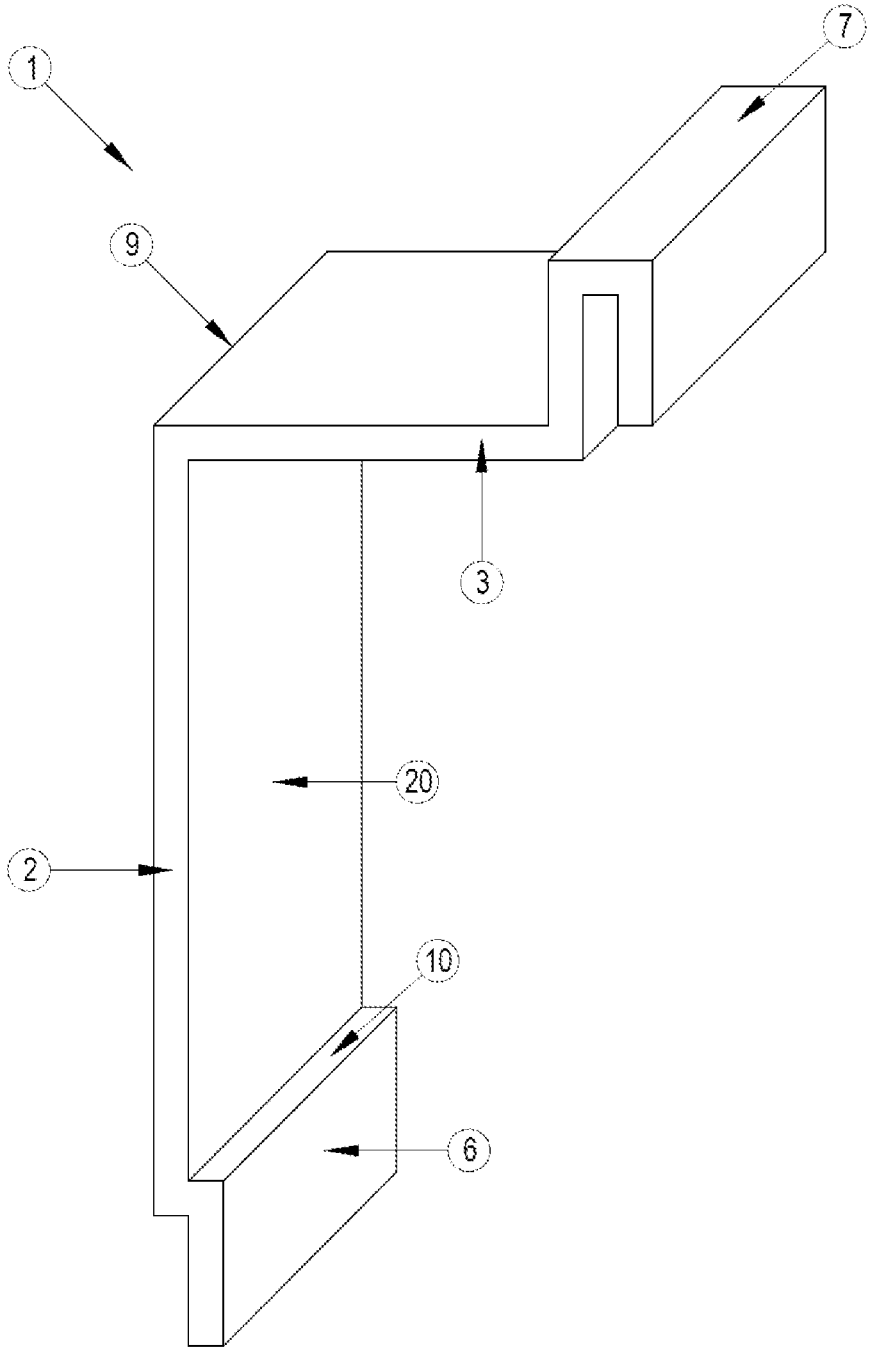
FIG. 11 shows a perspective view of a preferred embodiment of the fitting profile of the present invention.
Figure 12:
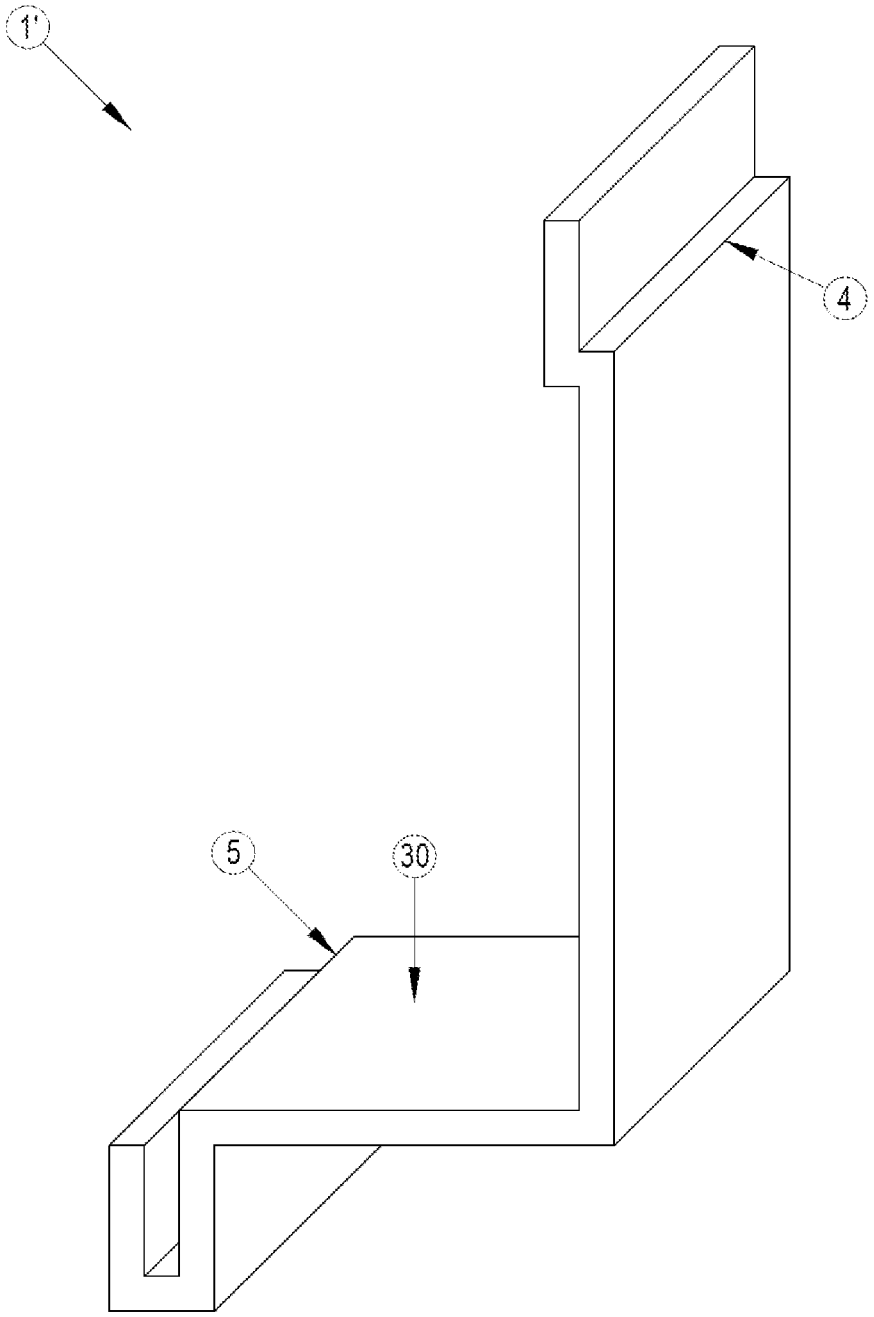
FIG. 12 illustrates the fitting profile depicted in FIG. 11 in an inverted position showing the inner surface of the tab comprising the fitting member of the female type.

In an exemplary embodiment, shoulder (10) is disposed at the end (4) of tab (2), as shown in FIG. 1. Preferably, shoulder (10) is disposed over the entire inner surface (20) and parallel to end (4), as illustrated in FIGS. 11 and 12. However, in other embodiments, shoulder (10) may provide a discrete arrangement (not shown) in a portion or portions of inner surface (20).

At the end (5) of tab (3) a fitting member (7) of the female type is disposed. This fitting member (7) is provided with an opening (11) having a thickness (h''), as is clearly visible in FIG. 1. In one embodiment, the fitting member (7) of the female type is disposed along the entire end (5). However, in other embodiments, the fitting member (7) of the female type may provide a discrete arrangement in a portion or portions of end (5) of the tab (3).

Preferably, the fitting member (7) of the female type has a U-shaped configuration. Other configurations within reach of the person of ordinary skill in the art are also contemplated, provided they are complementary to the respective shape of the fitting member (6) of the male type with which it will cooperate to form a fitting and a respective attachment.

Figure 2:
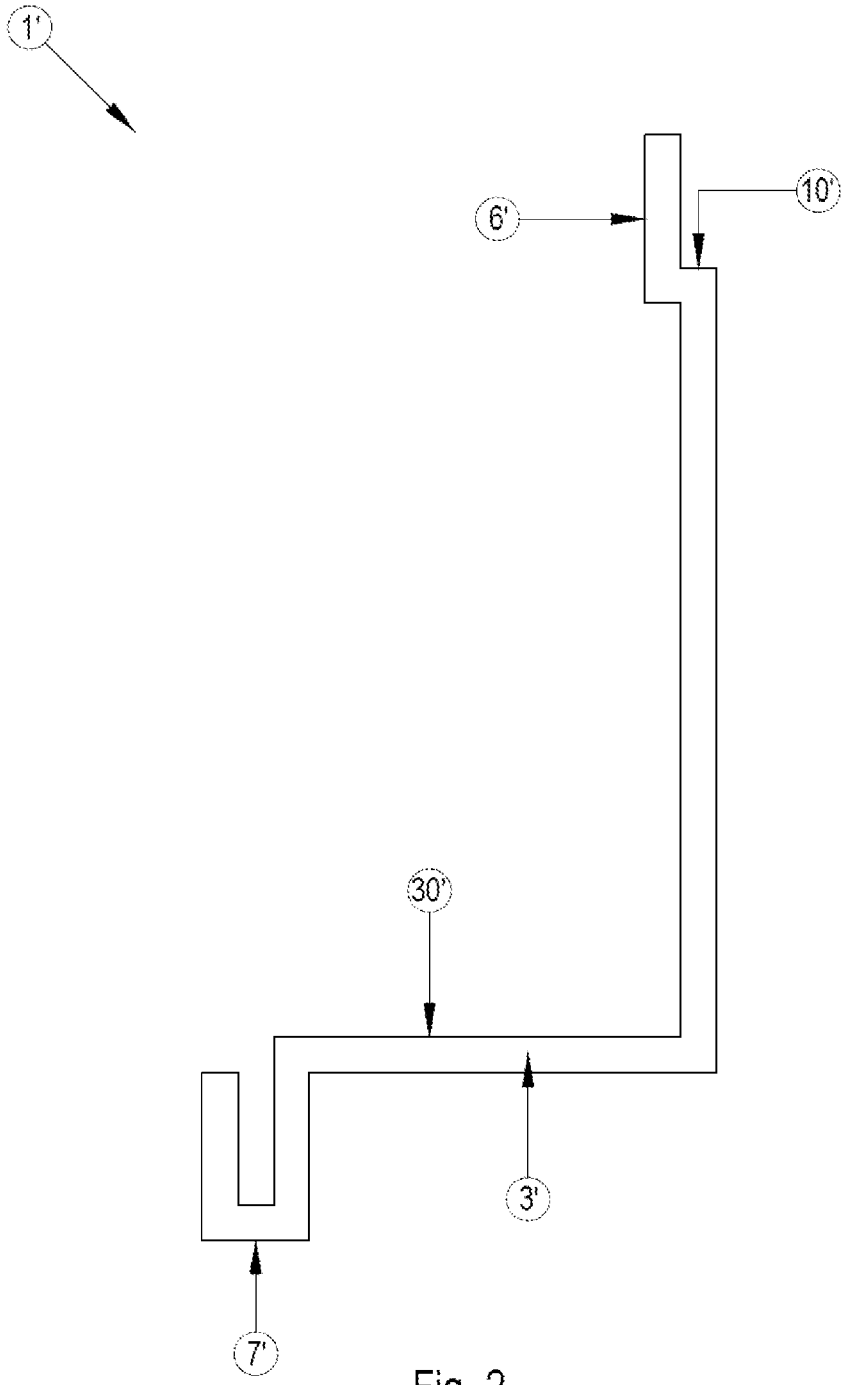
FIG. 2 shows the fitting profile depicted in FIG. 1 in an inverted position.
Figure 3:
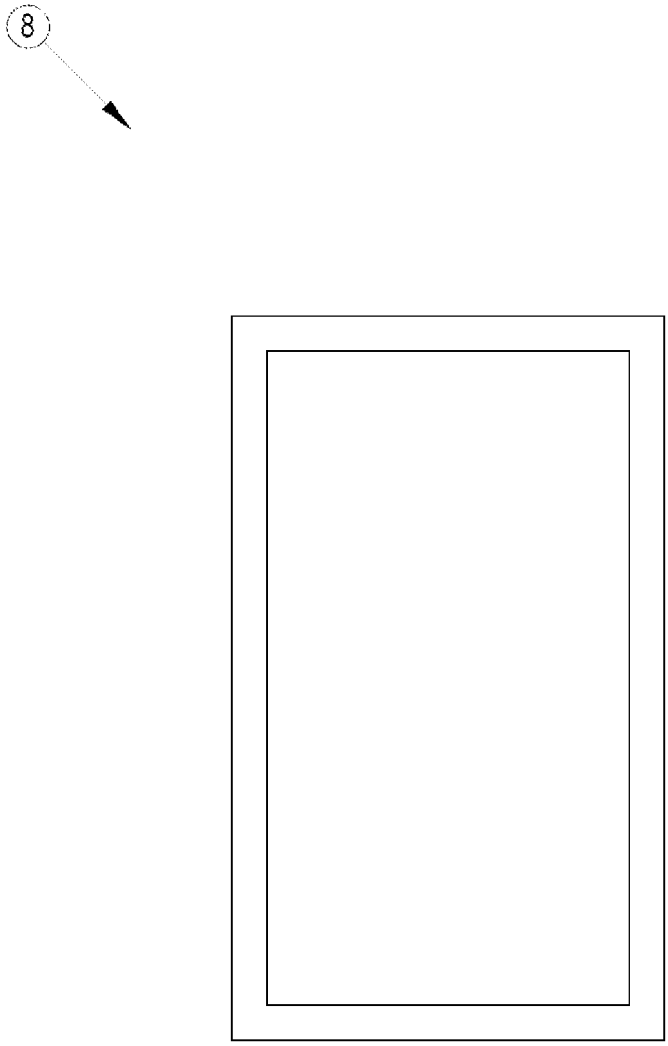
FIG. 3 shows a cross section of a locking member according to the present invention.
Figure 4:
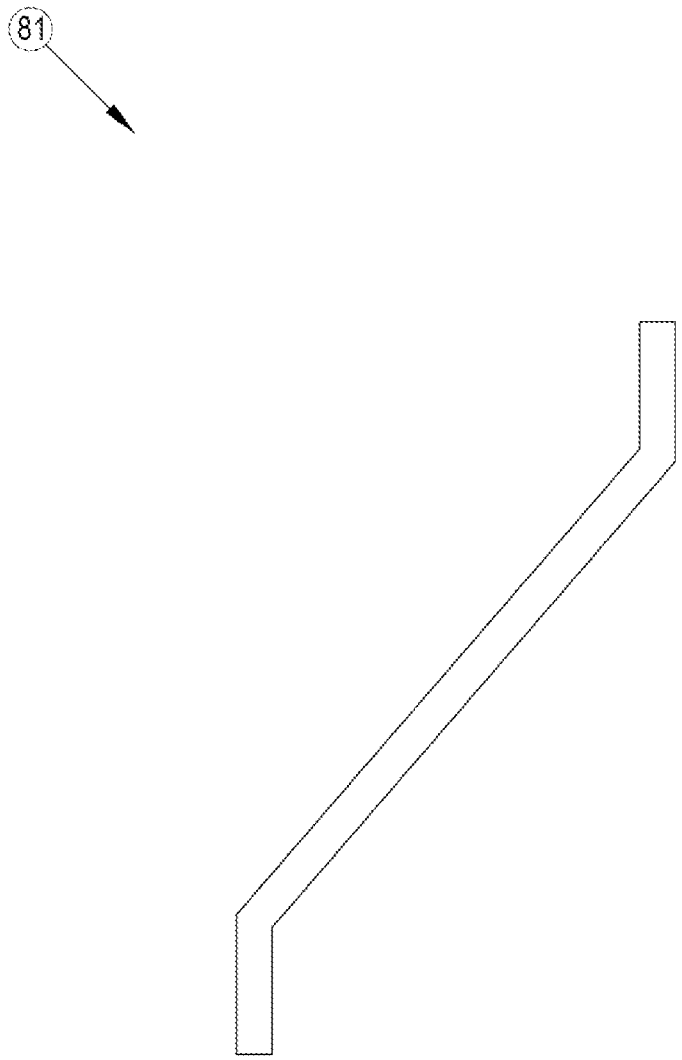
FIGS. 4 to 6 show exemplary embodiments of locking members of the present invention, respectively, a plate, a profile and a rod.
Figure 5:
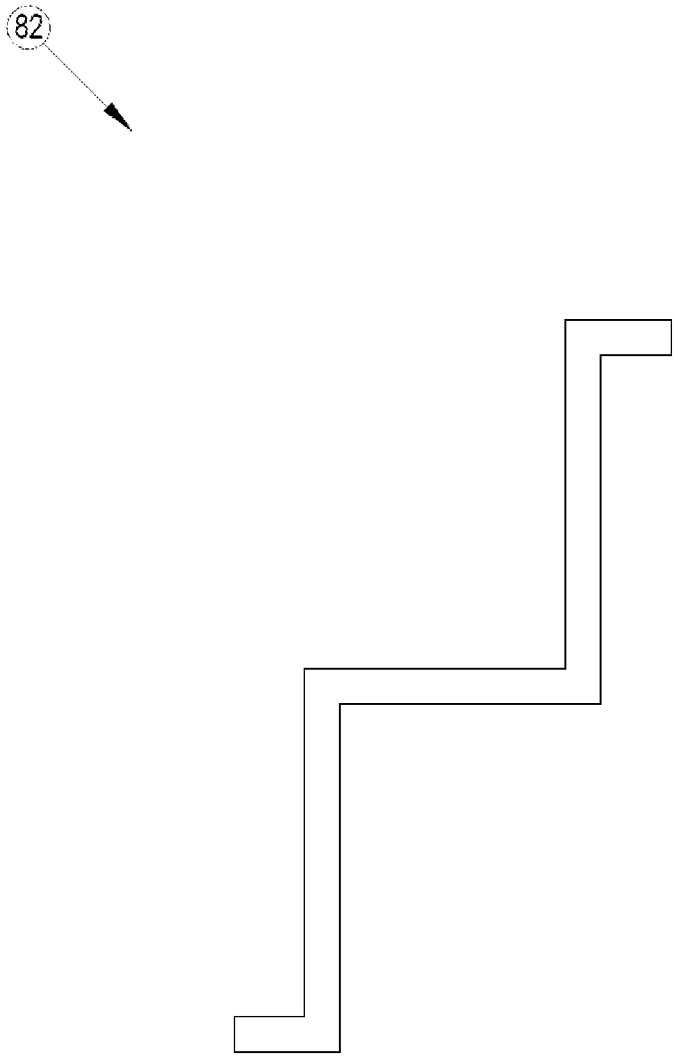
Figure 6:
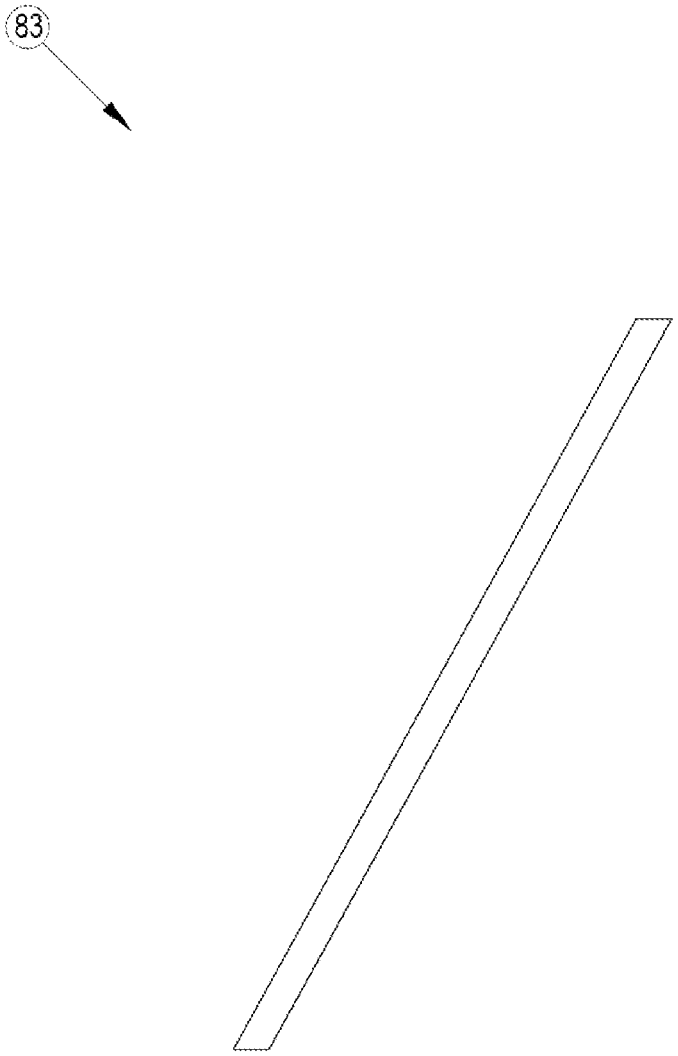

Thus, the shapes of the fitting member (6) of the male type and of the fitting member (7) of the female type are complementary relative to each other to allow a fitting attachment into a second profile (1') identically shaped, shown in FIG. 2.

In one embodiment of the invention, shoulder (10) and fitting member (6) of the male type are integrally disposed on the inner surface (20) of tab (2) and fitting member (7) of the female type is integrally disposed in end (5) of tab (3), forming a one-piece profile of the invention.

In one embodiment of the present invention, said thickness (h') of shoulder (10) is equal to a thickness (h) of profile (1).

In another embodiment, said thickness (h') of shoulder (10) is equal to or less than said thickness (h") of opening (11) of fitting member (7) of the female type.

In yet another embodiment, thickness (h") of opening (11) of fitting member (7) of the female type is equal to a thickness (h) of profile (1).

The profile (1) as defined is intended to receive a part or module to be fixed to either or both outer surfaces (21, 31) of tabs (2, 3) of profile (1) in order to form modular assemblies able to be fitted into each other to form construction components including but not limited to for example, exterior walls, interior dividing walls, floors and roofs, etc.

The invention further relates to a fitting profile system (12), the system (12) comprising two profiles (1, 1') such as defined above, and a locking member (8). Given the configuration of the profiles of the invention, these are able of being fitted into each other and locked in a simple manner by means of a locking member, as exemplified in FIGS. 7 to 10 and 17 to 20.

The locking members (8) can take several forms which are susceptible to allow its placement between shoulders (10, 10') of profiles (1, 1') which are already fitted.

Figure 14:
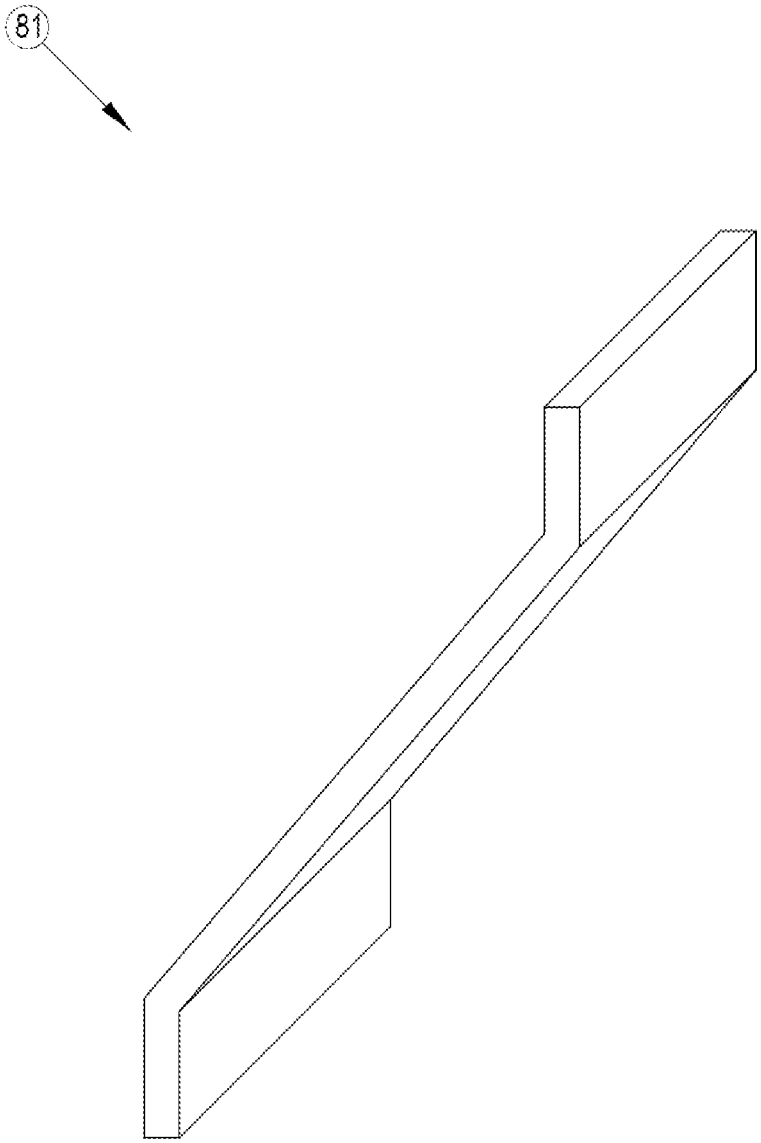
FIGS. 14 to 16 show perspective views of embodiments of locking members of the present invention, respectively, a plate, a profile and a rod.
Figure 18:
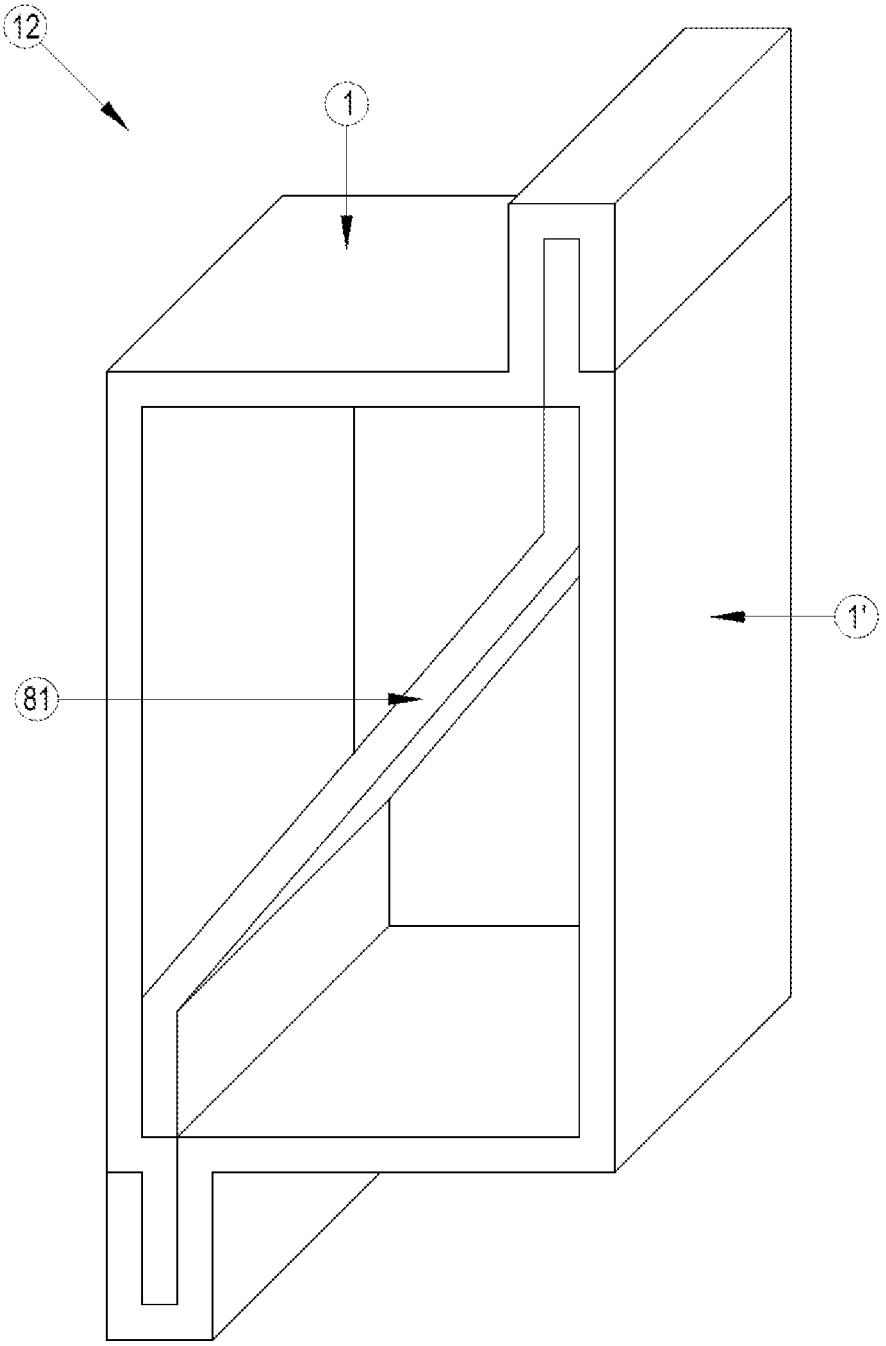
FIGS. 18 to 20 show perspective views of other exemplary embodiments of the fitting profile system of the present invention, after being assembled, which locking members are respectively a plate, a profile and a rod.

Thus, in one embodiment, locking member (8) is a plate (81), as illustrated by way of example in FIGS. 14 and 18.

Figure 13:
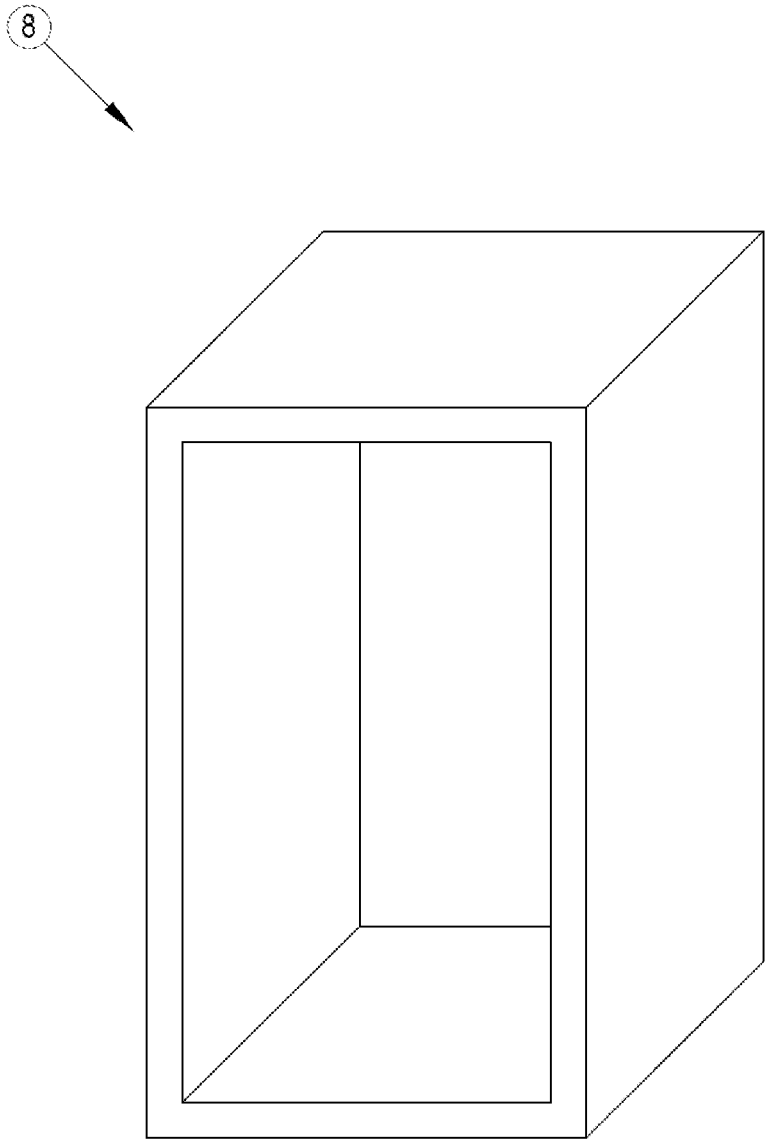
FIG. 13 shows a perspective view of a locking member according to the present invention.
Figure 15:
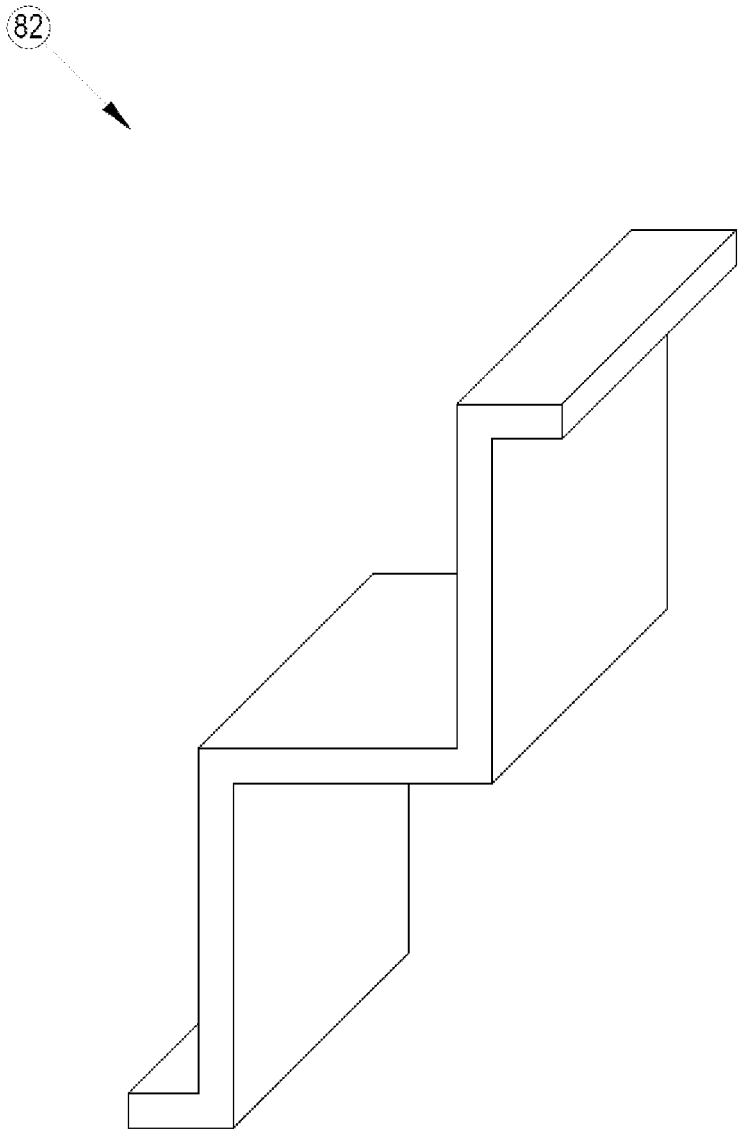
Figure 19:
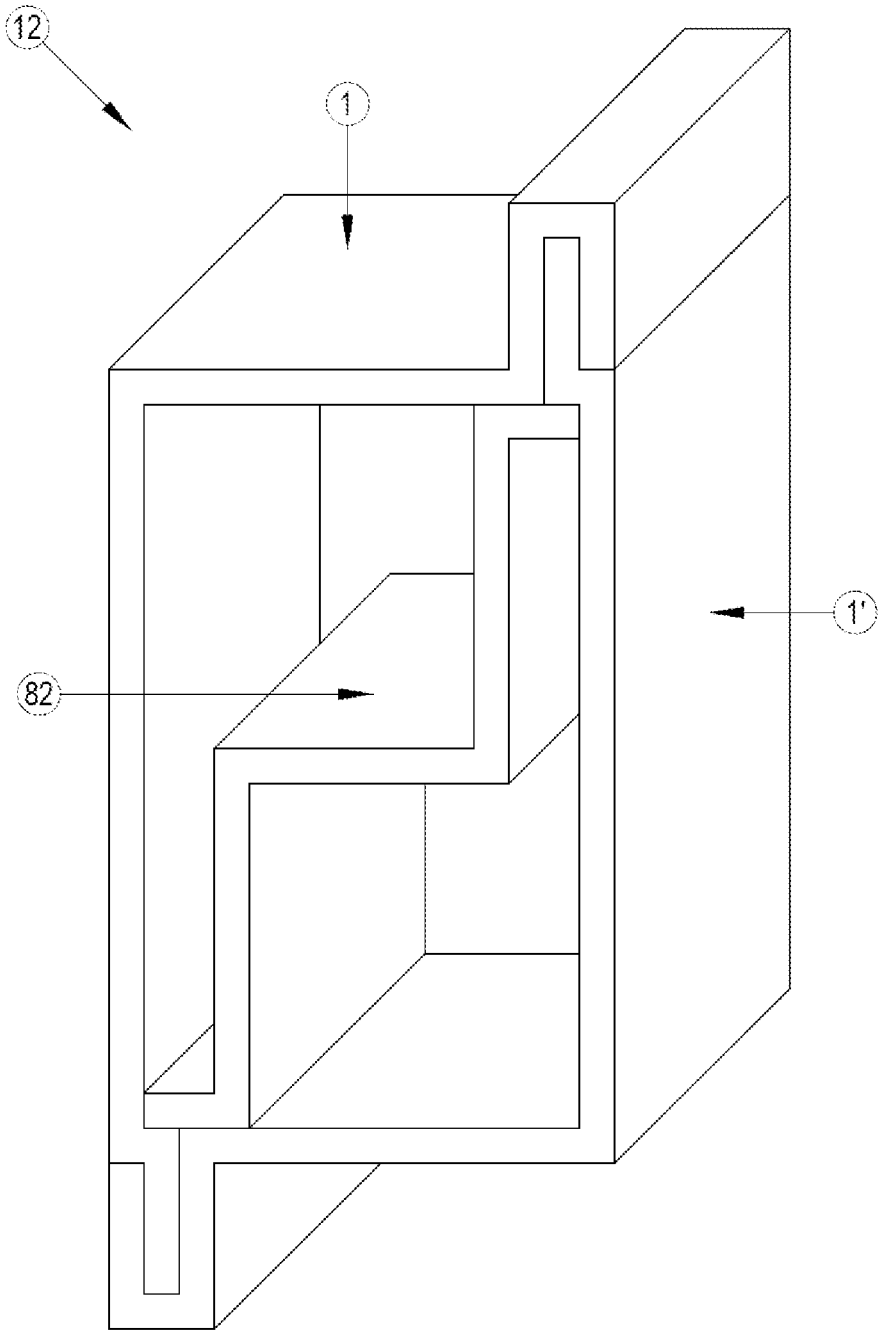

In another embodiment, locking member (8) is a profile (82), as illustrated by way of example in FIGS. 15 and 19. Naturally, other profile configurations are possible, in particular those which are already commercially available in construction profile industry, such as the exemplary rectangular profile of FIGS. 13 and 17, which is an advantage in terms of simplicity of production of profile system (12) of the present invention.

Figure 16:
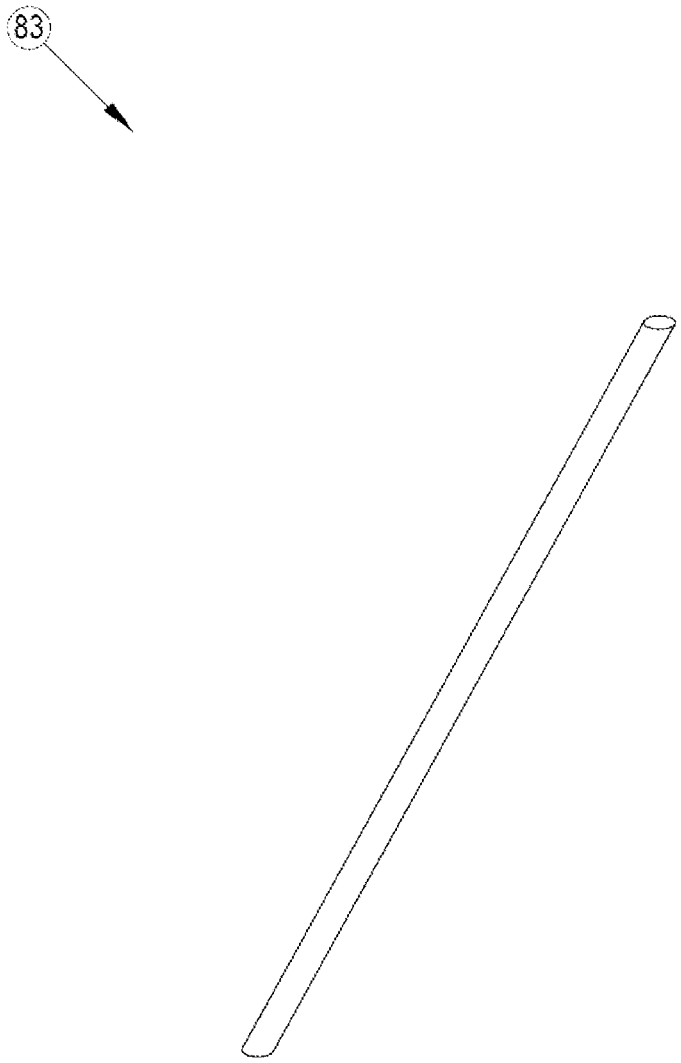
Figure 17:
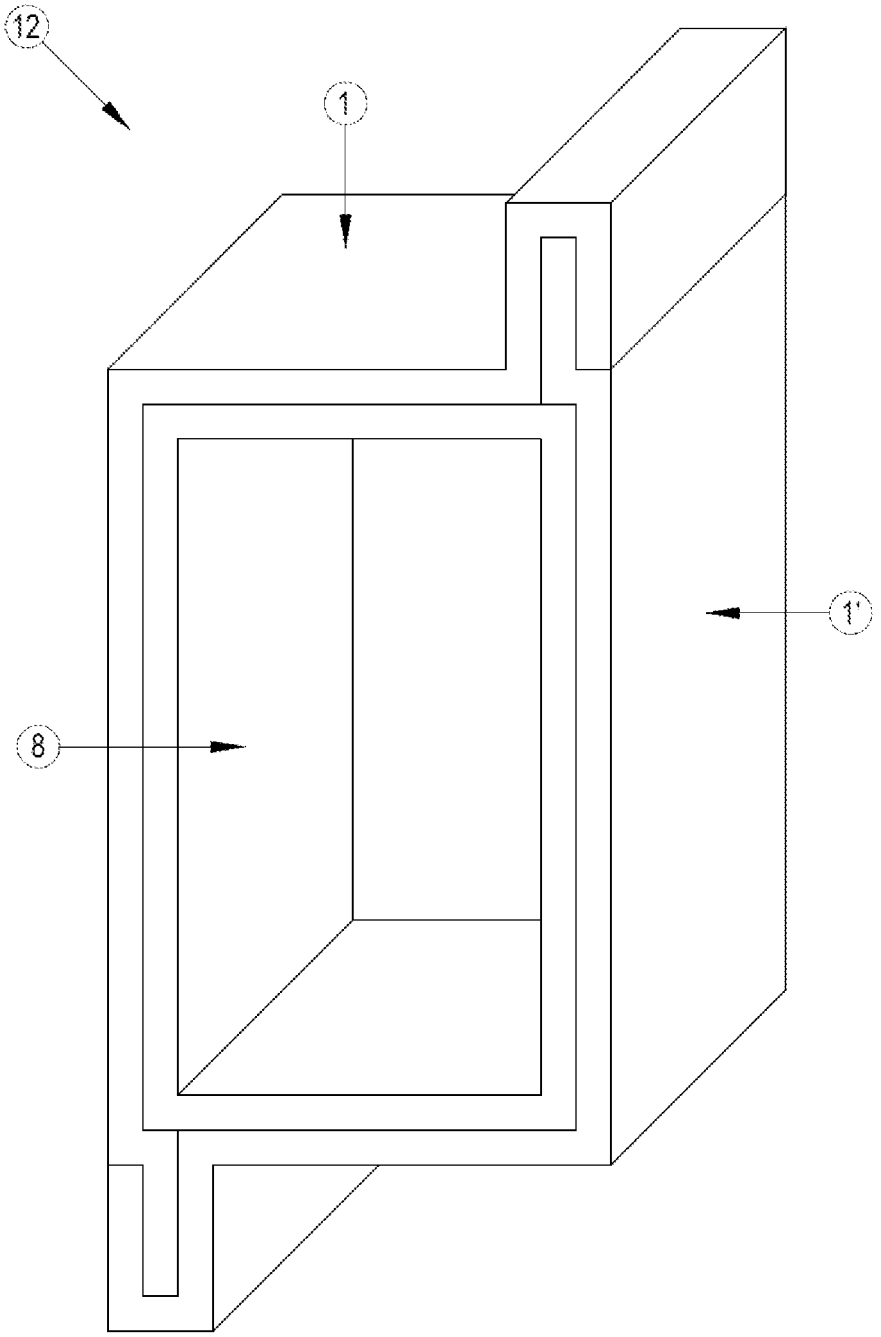
FIG. 17 shows a perspective view of an embodiment of the fitting profile system of the present invention after being assembled.
Figure 20:
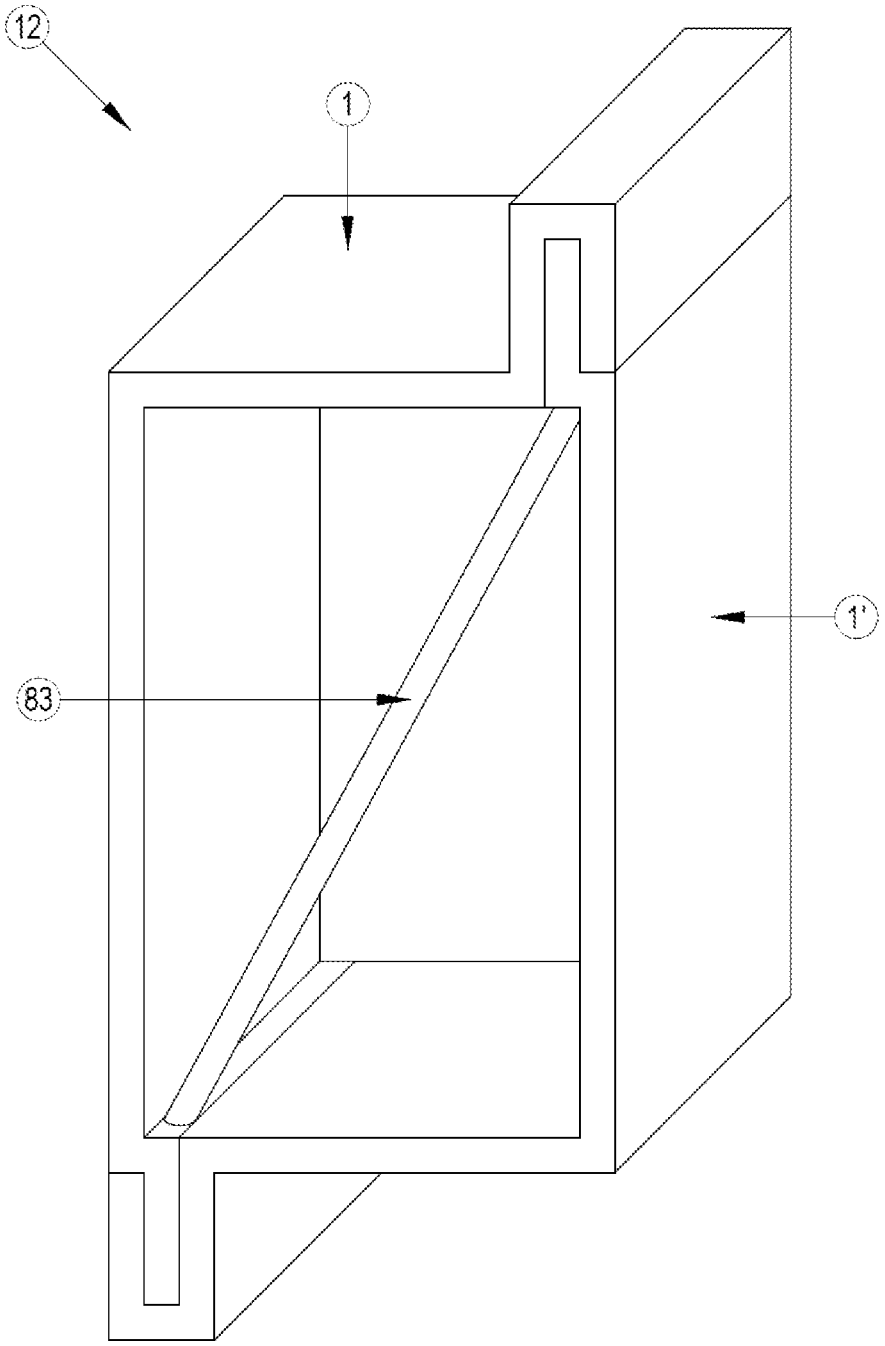

In yet another embodiment, locking member (8) is a rod or bar (83), as illustrated by way of example in FIGS. 16 and 20. The cross section of such a rod or bar may take any form compatible with a locking function, in particular said section can have a circular or parallelopipedic shape.

The present invention also relates to an assembly method of the fitting profile system (12) of the invention. Thus, the method comprises the steps of:

a) attaching two profiles (1, 1') of the system (12) of the invention by fitting the fitting members (6, 7) of profile (1) into fitting members (7', 6') respectively of profile (1'), and b) blocking the attachment performed in the preceding step by placing a locking member (8) between shoulders (10, 10') of respective profiles (1, 1').

Examples of systems (12) of the invention assembled using the method described above are illustrated in FIGS. 7 to 10 and 17 to 20.

Preferably, said locking member (8) is placed between shoulders (10, 10') of respective profiles (1, 1') by a sliding movement of the drawer type. This allows not only to simplify the assembly of the profiles, but also its disassembly, thereby eliminating the complex and time consuming locking and fastening stage of conventional profiles of the prior art, and also providing an easy conversion of the profiling system of the invention, where such conversion is required or desired.

Figure 7:
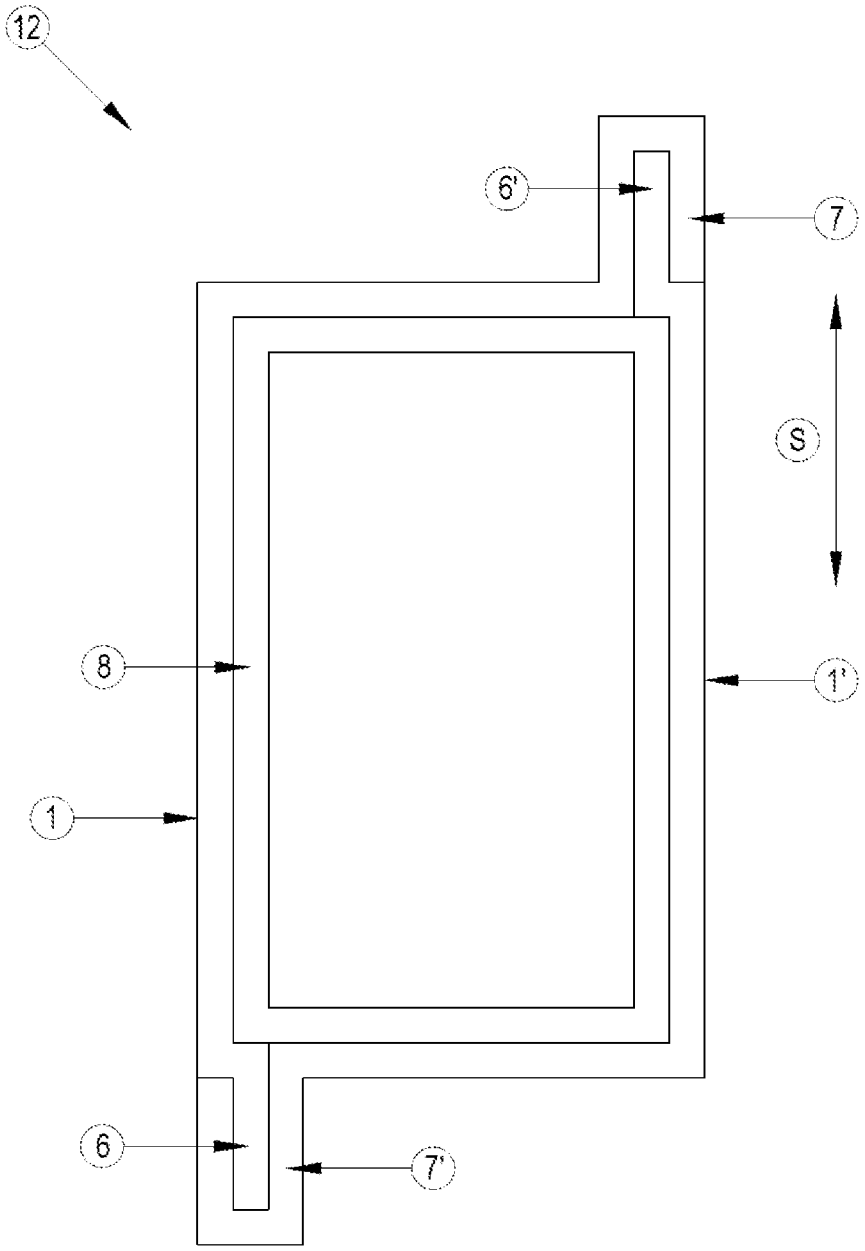
FIG. 7 shows a cross section of an embodiment of the fitting profile system of the present invention after being assembled.
Figure 8:
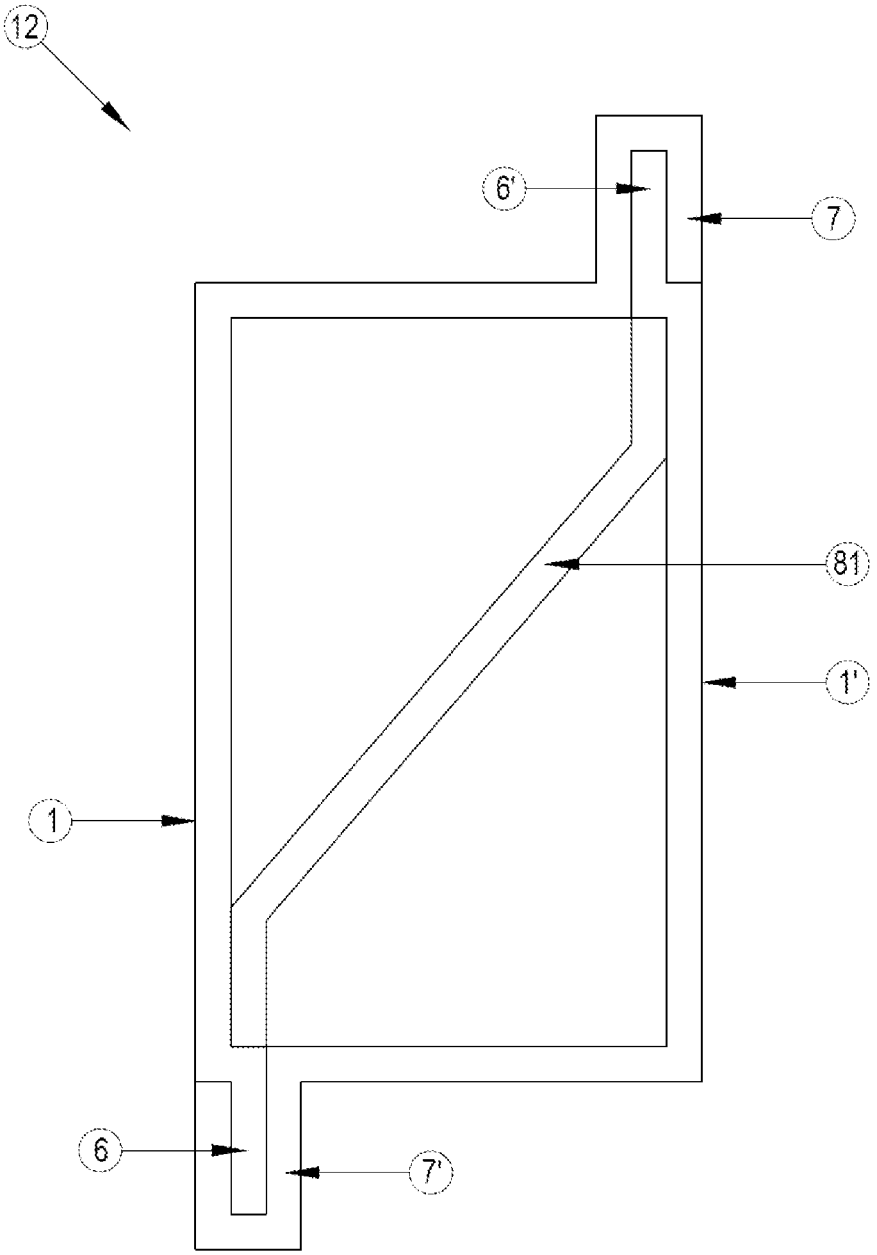
FIGS. 8 to 10 show further exemplary embodiments of fitting profile system of the present invention, after being assembled, in which various locking members, respectively a plate, a profile and a rod are used.
Figure 9:
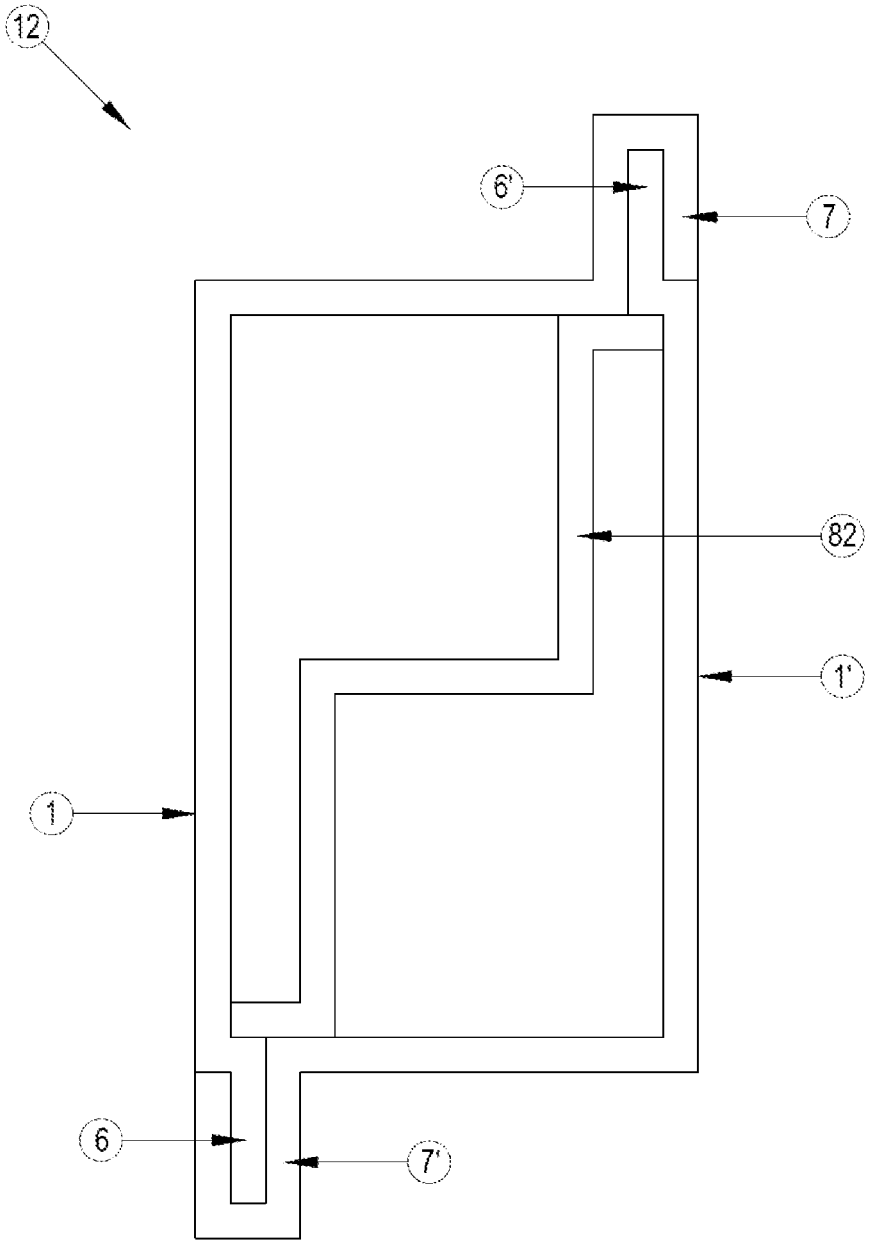
Figure 10:
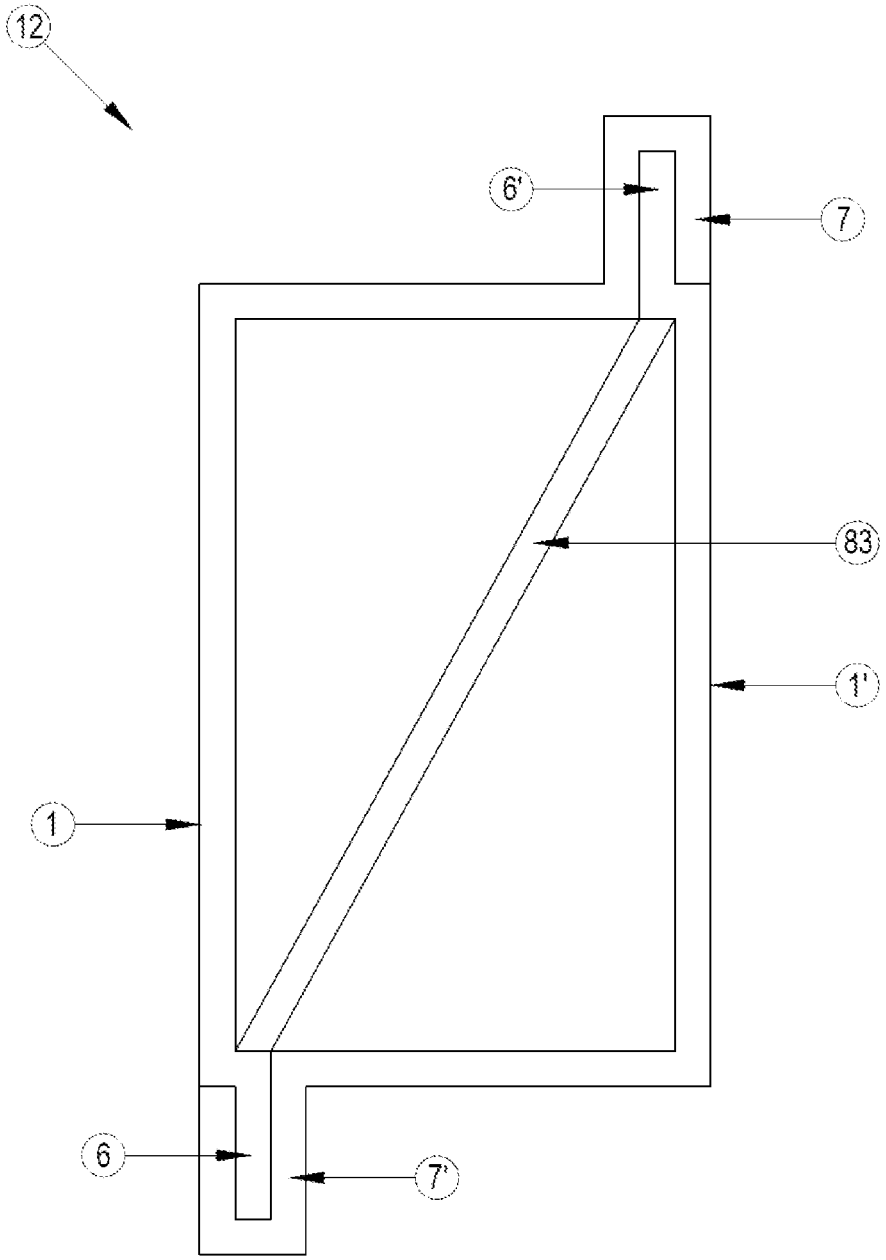

Note that locking member (8) prevents a relative movement of profiles (1, 1') in the directions indicated by arrows (S) in FIG. 7, that is, prevents inner surfaces (30, 30') of respective tabs (3, 3') from moving away from each other, thereby maintaining the profiles (1, 1') together.

The description herein should be understood as exemplary and not limiting the scope of the present invention, which is defined in the appended claims.

The invention claimed is:

1. A fitting profile for a constructive system comprising a first tab and a second tab connected perpendicularly to each other at a joint, each tab having respectively an inner surface, an outer surface and an end opposite to said joint, the fitting profile comprising:

a first tab comprising on its inner surface a shoulder having a thickness, at which said shoulder a first fitting member of a male type is disposed, said shoulder to cooperate with a locking member, the locking member being distinct from the fitting profile, in order to block attachment of the fitting profile with another identically shaped fitting profiles, the another identically shaped fitting profile being distinct from the fitting profile and the locking member, at an end of a second tab a second fitting member of a female type provided with an opening having a thickness is disposed, and a shape of each of said first and second fitting members is complementary relative to each other so as to allow a fitting attachment of the fitting profile into the another identically shaped fitting profile via the first and second fitting members, the locking member including corners on opposite ends thereof, one corner of the locking member engaging the shoulder of the fitting profile and another corner of the locking member engaging another shoulder of the another identically shaped fitting profile when the fitting profile and the another identically shaped fitting profile are coupled together.

2. The fitting profile according to claim 1, wherein said thickness of said shoulder is identical to a thickness of said fitting profile.

3. The fitting profile according to claim 1, wherein said thickness of said shoulder is equal to or less than said thickness of said opening of said second fitting member of the female type.

4. The fitting profile according to claim 1, wherein said shoulder is disposed over an entirety of said inner surface parallel to said end.

5. The fitting profile according to claim 1, wherein said thickness of said opening of said second fitting member of the female type is identical as a thickness of said fitting profile.

6. The fitting profile according to claim 1, wherein said fitting member of the female type is disposed along an entirety of said end.

7. The fitting profile according to claim 1, wherein said fitting member of the female type has a U shape.

8. The fitting profile according to claim 1, wherein said shoulder and said first fitting member of the male type are arranged integrally on said inner surface.

9. The fitting profile according to claim 1, characterized in that said second fitting member of the female type is arranged integrally on said end.

10. The fitting profile according to claim 1, wherein the locking member is rectangular in shape and the corners are two of four corners of the rectangular shape.

11. The fitting profile according to claim 1, wherein the locking member is straight bar shaped disposed between the shoulders of the fitting profile and the another identically fitting profile, the ends of the locking member being angled at least than 90 degrees to lock against the shoulders of the fitting profile and the another identically fitting profile.

12. The fitting profile according to claim 1, wherein the locking member includes two shoulder contact portions to contact the shoulders of the fitting profile and the another identically shaped fitting profile and a substantially straight portion between the two shoulder contact portions, the two shoulder contact portions having squared ends to engage the shoulders of the fitting profile and the another identically shaped fitting profile at a perpendicular angle and being coupled to the substantially straight portion at an angle greater than 90 degrees.

13. The fitting profile according to claim 1, wherein the locking member includes two shoulder contact portions to contact the shoulders of the fitting profile and the another identically shaped fitting profile and three intermediate portions between the two shoulder contact portions, the three intermediate portions forming a step shape.

14. A fitting profile system comprising two of said fitting profiles as claimed in claim 1, and said locking member.

15. The fitting profile system according to claim 14, wherein said locking member is a plate.

16. The fitting profile system according to claim 14, wherein said locking member is a rod or bar.

17. An assembly method of the fitting profile system as claimed in claim 14, a method comprises:

a) attaching two fitting profiles of said fitting profile system by fitting the first and second fitting members of said fitting profile into said first and second fitting members respectively of said fitting profile, and b) blocking the attachment performed in the attaching two fitting profiles by placing a locking member between shoulders of respective said two fitting profiles.

18. The method according to claim 17, wherein, in b), said locking member is placed between said shoulders of respective said two fitting profiles by a sliding movement of a drawer type.

* * * * *